United States Patent [19]

Koumal

[11] Patent Number: 4,634,318

[45] Date of Patent: Jan. 6, 1987

[54] INTEGRATED ROCK REINFORCEMENT SYSTEM AND METHOD USING A CONTINUOUS CABLE

[76] Inventor: George Koumal, 2001 N. Evelyn Ave., Tucson, Ariz. 85715

[21] Appl. No.: 620,699

[22] Filed: Nov. 23, 1984

[51] Int. Cl.[4] ..... E21D 20/00

[52] U.S. Cl. ..... 405/259; 405/288

[58] Field of Search ..... 405/258-261, 405/288; 52/223 L, 230; 299/11

[56] References Cited

U.S. PATENT DOCUMENTS

| | | | |
|---|---|---|---|
| 3,422,586 | 1/1969 | Parma | 52/230 |
| 3,427,811 | 2/1969 | White | 405/259 |
| 3,505,824 | 4/1970 | White | 405/259 |
| 3,601,994 | 8/1971 | Galis | 405/288 |
| 3,650,112 | 3/1972 | Howlett et al. | 405/260 |
| 4,160,615 | 7/1979 | Baldwin | 405/259 |
| 4,265,571 | 5/1981 | Scott | 405/259 |
| 4,413,928 | 11/1983 | Tucker | 405/288 X |

FOREIGN PATENT DOCUMENTS

| | | | |
|---|---|---|---|
| 271284 | 8/1964 | Australia | 405/259 |
| 409324 | 9/1966 | Switzerland | 52/230 |
| 606770 | 11/1978 | Switzerland | 405/259 |
| 943667 | 12/1963 | United Kingdom | 405/259 |

OTHER PUBLICATIONS

CF & I Mine Rock Bolts, CF & I Steel Corp., Publication M-153 (Rev.), Oct. 1974.

Rod Trusses, Birmington Bolt Co., SME Mining Engineering Handbook, vol. 1, p. 155, Ch. 13, FIG. 130, Port Press., Baltimore, Md., 1973.

Scott Cable Sling, Interior Rock Reinforcement Fixtures by J. J. Scott, p. 6, FIG. 17, Univ. of Missouri--Rolla, May 1980.

CF & I Mine Rock Bolts, CF & I Steel Corp., with Pattin Expansion Shells, Pattin Mfg. Co.

*Primary Examiner*—Cornelius J. Husar
*Assistant Examiner*—Nancy J. Stodola
*Attorney, Agent, or Firm*—Victor Flores

[57] ABSTRACT

A rock mass reinforcement for use in the mining, civil engineering industry or similar applications for reinforcing the rock mass in the rib and back of an excavation having a plurality of drill holes arranged in a reinforcement drill hole pattern, a continuous cable having one end initially anchored and its other end being free for sequential installation and tensioning at each drill hole of the drill hole pattern in combination with an anchor-pulley assembly for sequentially holding in slidable securement a looped end portion of the continuous cable at each drill hole of the drill hole pattern and a drill hole collar plate assembly having a drill hole collar plug and a plug insert, for sequentially locking applied tension on the continuous cable at each drill hole of the drill hole pattern. The reinforcement when installed in the rock mass results in a homogeneous reinforcement of fractures and joint oriented in multidirectional planes.

2 Claims, 5 Drawing Figures

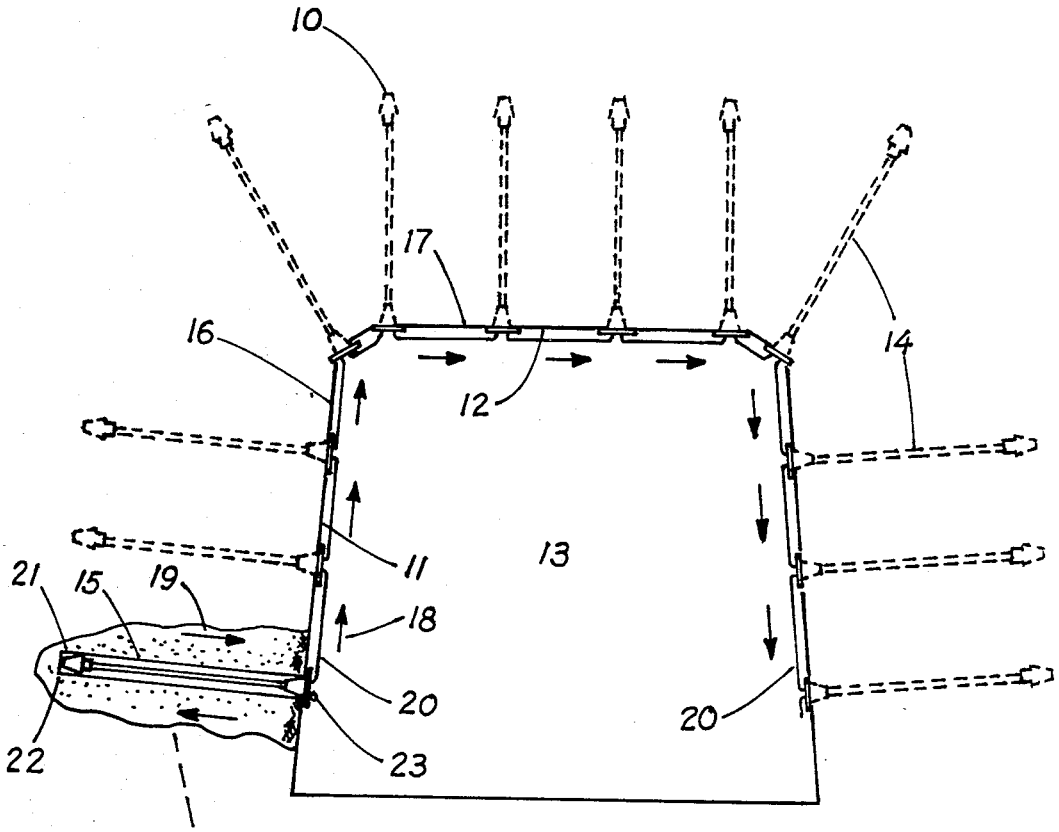
FIG. 1
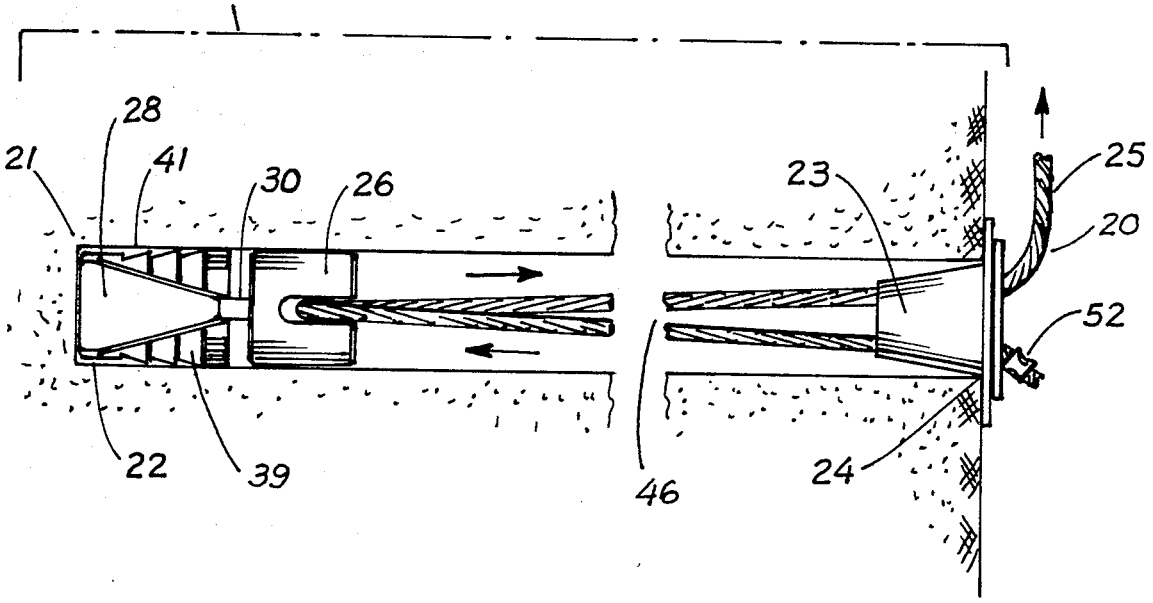

INTEGRATED ROCK REINFORCEMENT SYSTEM AND METHOD USING A CONTINUOUS CABLE

BACKGROUND OF THE INVENTION

1. Field of the Invention

The present invention generally relates to rock reinforcement methods and systems used in the mining and civil engineering industry where openings in rock, whether blasted or excavated, are reinforced to preserve the opening size and prevent collapse and, more particularly, is concerned with an improved reinforcement system having apparatus and method for reinforcing the rock mass around the opening regardless of the orientation of joints or fractures in the rock mass. The improved rock reinforcement system enhances stability and strength of the opening.

2. Description of the Prior Art

Rock reinforcement methods and procedure, evolve around three fundamental elements and their combinations, namely rock bolts of different designs and forms, use of cables and prestressed cables, and utilization of concrete in form of grouting or shotcrete applications. Rock bolts are most useful in bedded rock formation, where purpose of bolting is to tighten together several layers to combine their ability to resist a bending moment. Typically, in the Western United States rock bolts such as those manufactured by CF&I Steel Corporation with expansions shells manufactured by Pattin Mfg. Co. are used in these applications. However, rock bolts utilization has problems which are as basic as bolt spacing. In actual practice, with no clear knowledge of bedding, rock mass fracture, and jointed in all directions, the questions of bolt length, bolt diameter and spacing are quite different and sometimes outright impossible to answer. Rock bolt reinforcement design has disadvantages in rock mass formations having vertical joints perpendicular to cross section of the opening. In such cases some rock layers will be out of the influence of the bolting and will become loose and present a hazardous situation. Solutions for these situations include the use of a wire mesh held up by the rock bolt plates or possibly in combination with shotcrete to function as passive support. The combination of rock bolt lateral tension in the vertical direction and the horizontal tensioning of the wire mesh and shotcrete provides the desired reinforcement of the opening. Other solutions to the problem could involve the construction of a back reinforcement utilizing the principles of the Roman arches. Such solutions known to the mining industry are rock reinforcement methods involving rebar with rock stabilizers, Birminham Bolt Company rod trusses and Scott's cable sling. Although these method and associated system apparatus provide an adequate solution they are limited in providing a continuous reinforcement solution to the problem in that effective back reinforcment can only be achieved in a small area, i.e. to that rock mass between two rock bolts and not throughout an entire excavation or drift drill hole pattern.

Consequently, a need exists for a rock reinforcement system and method having apparatus which will overcome the limitation of not providing a continuous and hazard free reinforcement while effectively solving the problem of providing a two directional reinforcement of the back or roof of a mine drift or similar excavation regardless of the orientation of the joints or fractures in the rock mass.

SUMMARY OF THE INVENTION

The principal object of the invention is directed at providing for the mining or civil engineering industry an improvement in rock reinforcement methods used to reinforce the rock mass in rib or back of an excavation. The improvement provides a method of using a tensioned, single and continuous cable for continuously integrating horizontal and vertical forces produced on the rock mass by the tensioned cable as defined by a drill hole pattern in the rib and back of an excavation or similar applications. The integrated drill hole pattern results in a homogeneous reinforced rock mass structure. The integrated rock reinforcement method can essentially "sew" a set of drill holes in any desired pattern to accomplish an optimum reinforcement design for the excavation. The present invention thus provides an alternative for the industry in rock reinforcement methods and satisfies a need for a system which can continuously integrate a drill hole pattern and provide a homogeneous reinforcement of the rib and back of an excavation or similar application.

Another object of the invention is to provide the novel system apparatus for continuously integrating the drill hole pattern in the rib and back of an excavation to accomplish the principal object of the invention.

Accordingly, the present invention relates to apparatus and method for reinforcing the rock mass in the rib and back of an excavation or similar application, which includes the operative steps of anchoring a continuous cable in a drill hole and locking applied tension at the collar end of the drill hole. The invention may also include the step of preparing the apparatus before anchoring as well as the step of repeating the aforementioned steps of anchoring and locking the continuous cable. More specifically, the anchoring is accomplished by an anchor-pulley assembly which has an anchor end that communicates with an expansion shell and a pulley end which communicates with the loop end of the continuous cable. Also the locking is accomplished by a drill hole collar plate assembly which allows feed-through of the doubled up continuous cable and provides an opening for an insert to lock the doubled up portions of the cable against the sides of the opening after tension has been applied at the loose end of the continuous cable.

Therefore, to the accomplishment of the foregoing objects, the invention consists of the features hereinafter illustrated in the drawings and fully described in the detailed description of the preferred embodiment and particularly pointed out in the claims. However, such drawings and description disclosing but one of the various ways in which the invention may be practiced.

BRIEF DESCRIPTION OF THE DRAWINGS

FIG. 1 is a cross section of a mine drift showing a typical drill hole pattern in the rib and back provided with the continuous cable rock reinforcement system in accordance with the present invention. Also shown is an enlarged view of a typical drill hole showing a detailed installation of the system apparatus.

DETAILED DESCRIPTION OF THE PREFERRED EMBODIMENT

Figures 2, 3:
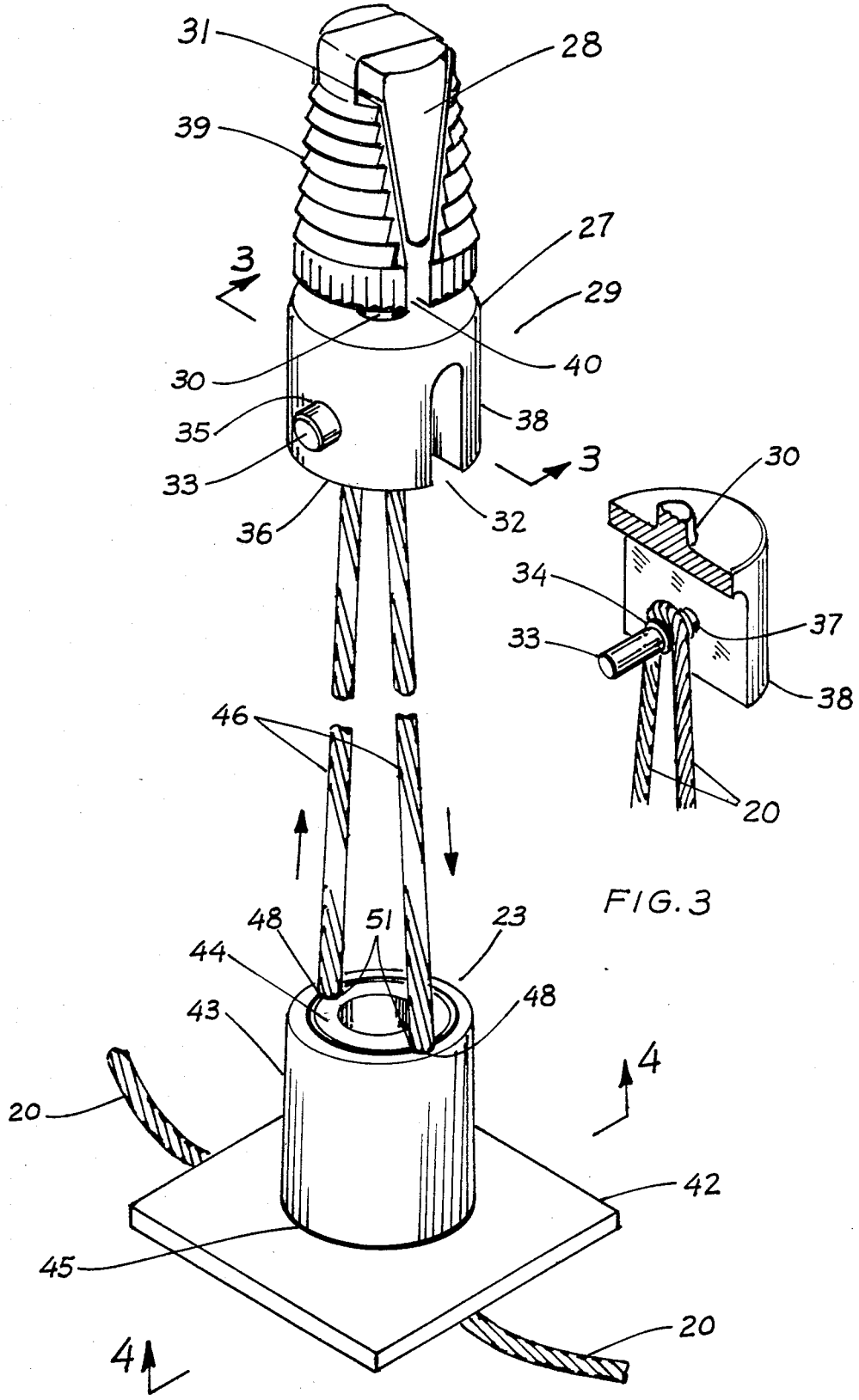
FIG. 2 is a perspective view showing the detailed assembly of the system apparatus in a manner typical of what would be done prior to installation in a drill hole.
FIG. 3 is a fragmented cross section of the pulley end of the anchor-pulley assembly showing the looped end of the continuous cable fitted over the tube and pin portion of the pulley.

Referring now to the drawings, and more particularly, to FIG. 1, there is shown the rock reinforcement system, generally designated 10, for use in the mining, civil engineering industry or similar application. The reinforcement system 10 can be typically installed to provide rib reinforcement 11 and back reinforcement 12 in a mine drift generally shown at 13. Mine drift 13, is generally provided with suitable drill holes 14 in a pattern generally shown at 14. The reinforcement system 10 basically includes reinforcing means 15 for continuously reinforcing the rock mass in rib 16 and the rock mass in back 17 and producing horizontal tension 18 and lateral tension 19. Also, as shown in the enlargement of FIG. 1, the reinforcing means 15 principally includes continuous cable means 20, anchor-pulley means 21 and cable locking means 23.

In the preferred embodiment of the invention shown in FIGS. 1, 2 and 3, anchor-pulley means 21 includes a body portion 27 having a an expansion shell insert end 28 and a pulley end 29, the pulley end being separated from the expansion shell insert end by a neck portion 30. Pulley end 29 being constructed in the form of a two-pronged fork 32 having bearing eyelet 35 on first prong 36 and a recessed bearing hole 37 on the inside wall of second prong 38. Eyelet 35 and bearing hole 37 being used to removeably install a pulley pin 33. In actual practice pin 33 first being inserted through eyelet 35 then through tube 34 before being inserted in hole 37, tube 34 having the looped end of cable 20 positioned above it for end use. Expansion shell insert end 28 being shaped and formed as in a wedge to fit within the inner structure 31 of expansion shell 39. Expansion shell 39 having longitudinal slots 40 which will expand against hole wall 41 upon reacting to tension applied on cable 20 at loose end 25.

Figure 4:
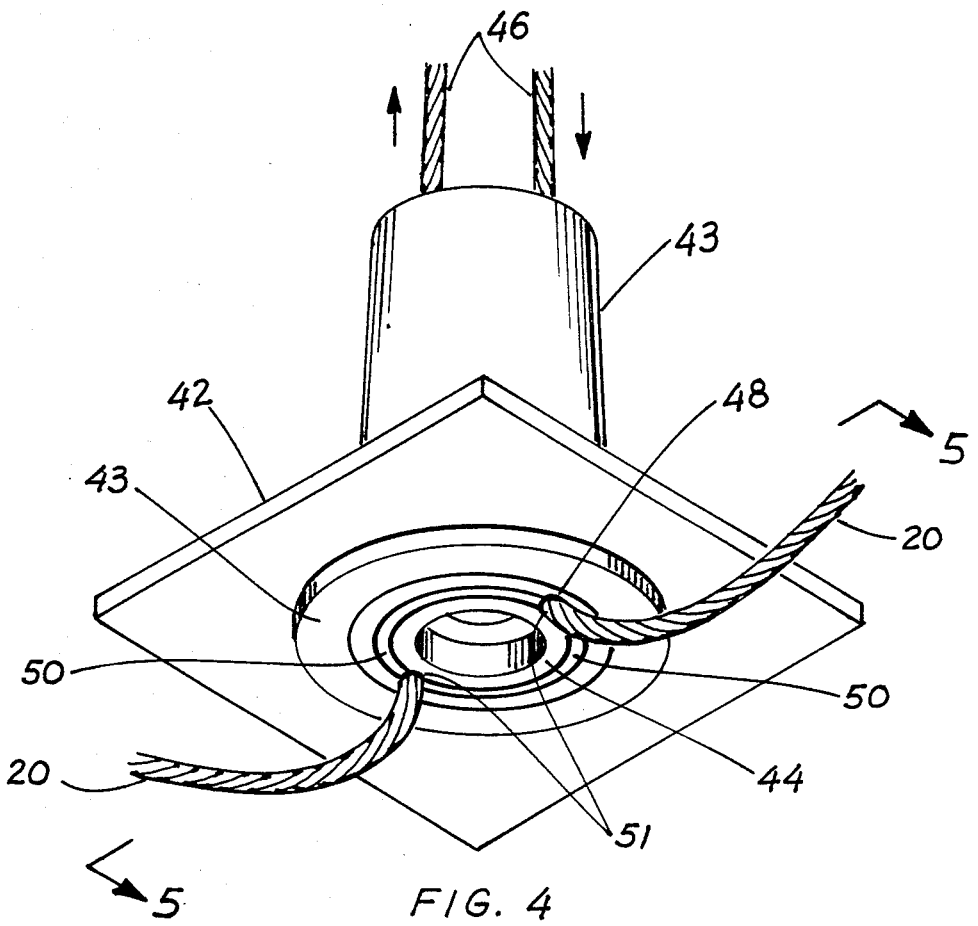
FIG. 4 is a perspective view of the drill hole collar plate assembly showing the doubled up cable locked in place by the plug insert portion of the drill hole collar plate assembly.
Figure 5:
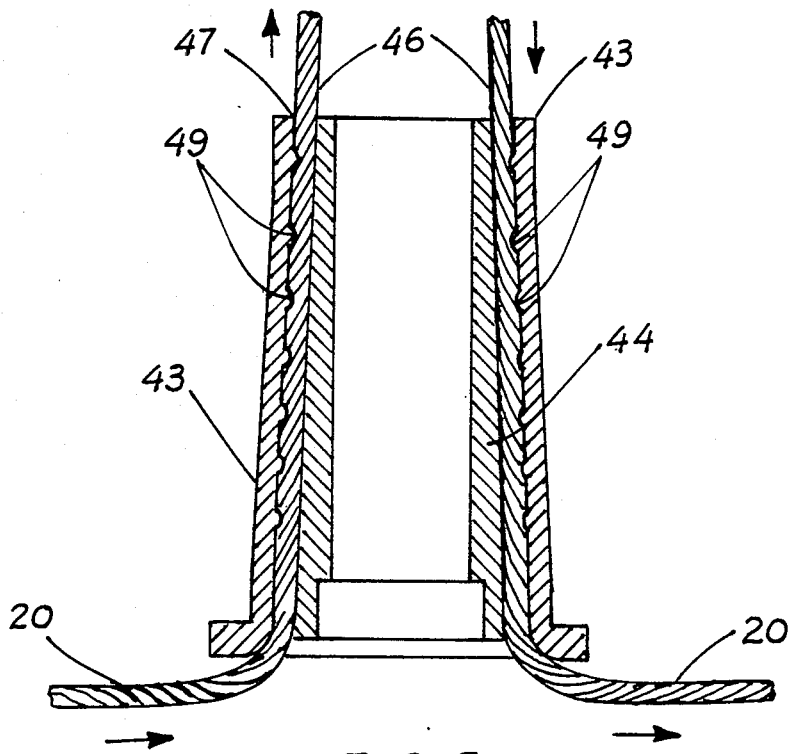
FIG. 5 is a fragmented cross sectional view of the drill hole collar plate assembly showing the doubled up portions of the cable fitted in the channels of the hole collar plug and hole collar plug insert.

Also in the preferred embodiment as shown in FIGS. 2, 4 and 5, cable locking means 23 includes a drill hole collar plate 42, a drill hole collar plug 43, and a drill hole collar hole plug insert 44. Drill hole plate 42 being provided with a suitably sized opening 45 to allow proper positioning of the drill hole collar plug 43 in drill hole 14 upon application of tension on cable 20 at 25. Drill hole collar plug 43 being sized to fit within drill holes 14 and to fit through plate 42, plug 43 having an opening 50 suitably sized to a accept doubled up cable 46 as well as drill hole collar plug insert 44. Drill hole collar plug 43 additionally having a pair of opposed and suitably dimensioned channels 48 located on the inner cylindrical wall structure 47 of plug 43 for accepting doubled up cable 46 during the application of tension at 25. Channel 48 having serrations 49 in the channel bed to enhance retention of cable 20. Drill hole collar plug insert 44 being sized and shaped to fit within hole plug opening 50 for purposes of locking applied tension, plug insert 44 having a pair of complementary channels 51 which will concentrically match channels 48 in plug 43 and further assist in locking continuous cable 20 upon application of tension at loose end 25.

In actual practice, the integrated rock mass reinforcement method begins by anchoring one end of continuous cable means 20 to an arbitrary initial anchor point, shown generally at 52, then sequentially placing and tensioning continuous cable means 20, in combination with anchor-pulley means 21 and cable locking means 23, in each of the drill holes of the reinforcement drill hole pattern and thereby provide an integrated, homogeneous reinforcement of the rib and back of drift 13.

In detail, at each drill hole of the drill hole pattern, continuous cable means 20 is doubled up to form a looped end 46 which is inserted through opening 50 of plug 43, then plug 43 with looped end 46 is loosely positioned in opening 45 of plate 42 such that looped end 46 extends sufficiently such that it can be placed between prong 36 and prong 38 and thereat be slideably secured by pin 33 and tube 34. At this point, anchor-pulley means 21, with slideably secured looped end 46 of cable 20, can be shoved into the drill hole to drill hole depth 22. Since expansion shell 39 is designed to provide outward spring tension on drill hole walls 41 as anchor-pulley means 21 is being shoved into the drill hole, looped end 46 and anchor-pulley means 21 will be adequately held in place until tensioned. To complete the installation at each hole, plug 43 with plate 42 are positioned in drill hole collar end 24 then, assuming that one end of cable 20 is anchored, either at an initial anchor point, or at a previously tensioned drill hole, loose end 25 of continuous cable 20 is tensioned and plug insert 44 is inserted in plug hole 50 thereby locking the applied tension.

It is thought that the improved rock reinforcement apparatus and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A rock mass reinforcement method for use in excavations having a rib and back rock mass with fractures and joints oriented in multi-directional planes, the excavation being provided with a plurality of drill holes in a drill hole reinforcement pattern and a continuous cable having one end anchored to an initial anchor point, said method comprising the steps of:

(a) doubling a loose end portion of said anchored continuous cable to form a looped end;

(b) installing a drill hole collar plate assembly over said looped end of said continuous cable;

(c) positioning said looped end of said continuous cable over a pulley member of an anchor-pulley assembly;

(d) positioning into a drill hole, said anchor-pulley assembly having said looped end of said continuous cable;

(e) activating a spring-loaded expansion shell member of said anchor-pulley assembly positioned in said drill hole;

(f) positioning said drill hole collar plate assembly into said drill hole having said anchor-pulley assembly and said looped end of said continuous cable positioned therein;

(g) applying tension on a loose end portion of said continuous cable extending from said drill hole having positioned therein said anchor-pulley assembly, said looped end of said continuous cable and said drill hole collar plate assembly; and (h) locking said applied tension on said continuous cable by inserting a plug insert member into a drill hole collar plug member of said positioned drill hole collar plate assembly, whereby said locking of applied tension, anchors said continuous cable in a manner equivalent to said initial anchor point; said recited steps being sequentially repeated at each drill hole of said reinforcement drill hole pattern until said plurality of drill holes of said reinforcement pattern have been tensioned with said continuous cable thereby reinforcing said fractures and joints oriented in multi-directional planes in said rock mass of said excavation.

2. A rock mass reinforcement system for use in excavations having a rib and back rock mass with fractures and joints oriented in multi-directional planes, the excavation being provided with a plurality of drill holes in a drill hole reinforcement pattern, said system comprising:

(a) a continuous, cable, having one end anchored to an initial anchor point and its other end sequentially installed and tensioned at each drill hole of said plurality of drill holes of said reinforcement drill hole pattern;

(b) a drill hole collar plate assembly for locking applied tension on said continuous and tensioned cable as it is sequentially installed at each drill hole of said plurality of drill holes, said drill hole collar plate assembly including a drill hole collar plate, a drill hole collar plug, and a drill hole collar plug insert, said drill hole collar plug having a cylindrical inner wall provided with an opposed pair of suitably dimensioned channels, said channels being serrated to provide a frictional bearing surface to aid in locking applied tension, said drill hole collar plug insert being sized and shaped to fit within said hole collar plug and provided with a complementary pair of serrated channels for frictionally locking said applied tension; and (c) an anchor-pulley assembly comprised of a neck portion having an anchor end and a pulley end, said anchor end having a drill hole expansion shell insert and a loosely fitted drill hole expansion shell, said expansion shell insert being sized and shaped, as in a wedge, to fit within said drill hole expansion shell, said pulley end having a first and second prong with a pulley assembly installed therebetween, whereby said continuous cable is held in slideable securement by said anchor-pulley assembly as said continuous cable is sequentially installed throughout said drill hole reinforcement patterns.

* * * * *